US005113141A

United States Patent [19]

Swenson

[11] Patent Number: 5,113,141

[45] Date of Patent: May 12, 1992

[54] FOUR-FINGERS RFQ LINAC STRUCTURE

[75] Inventor: Donald A. Swenson, San Diego, Calif.

[73] Assignee: Science Applications International Corporation, San Diego, Calif.

[21] Appl. No.: 554,797

[22] Filed: Jul. 18, 1990

[51] Int. Cl.[5] ..... H01J 25/10

[52] U.S. Cl. ..... 328/233; 328/228; 315/5.34

[58] Field of Search ..... 328/233, 228; 315/5.34, 315/5.41

[56] References Cited

U.S. PATENT DOCUMENTS

| | | | |
|---|---|---|---|
| 4,211,954 | 7/1980 | Swenson | 315/5.41 |
| 4,485,346 | 11/1984 | Swenson et al. | 328/233 |
| 4,596,946 | 6/1986 | Pottier | 313/233 |
| 4,906,896 | 3/1990 | Swenson | 315/5.41 |

OTHER PUBLICATIONS

Kapchinskiy, I. M., "History of RFQ Development", *The Institute for Theoretical and Experimental Physics*, 117259, Moscow (Dec. 1984).

Stokes et al., "The Radio-Frequency Quadrupole: General Properties and Specific Applications", Los Alamos Scientific Lab. (Dec. 1980).

Swenson, "PIGMI a Pion Generator for Medical Irradiation", LAL-81-6 Mini Review, Los Alamos National Laboratory, Feb. 1981.

Jamesson, R. A., "Introduction to RFQ Session", Los Alamos National Laboratory (Dec. 1984).

Schriber, S. Q., "Present Status of RFQ's", Los Alamos National Laboratory (Dec. 1985).

Staples, J., "RFQ's in Research and Industry", Lawrence Berkeley Laboratory (Dec. 1986).

Schempp, A., "Recent Progress in RFQ's", University of Frankfurt, Dec. 1988.

*Primary Examiner*—Donald J. Yusko

*Assistant Examiner*—Nimeshkumar Patel

*Attorney, Agent, or Firm*—Fitch, Even, Tabin & Flannery

[57] ABSTRACT

A new RFQ linac structure extends the useful range of beam velocity by a factor of 2 to 4 and beam energy by a factor of 4 to 16. Four-finger electrodes extend into each accelerating cell and provide quadrupole focusing of beam particles along a beam axis. The finger electrodes of adjacent cells also provide quadrupole acceleration of the beam particles along the beam axis. The finger of adjacent cells are oriented in accordance with a prescribed pattern. The pattern orientation of the fingers provides an additional degree of freedom that allows the periodcity of the focal structure to be independent of the periodicity of the accelerating structure. This makes it possible to double the rf frequency periodically to enhance the acceleration rate while holding the focusing strength constant.

16 Claims, 5 Drawing Sheets

FOUR-FINGER RFQ (N=1)

FOUR-FINGER RFQ (N=2)

FOUR-FINGER RFQ (N=3)

FOUR-FINGERS RFQ LINAC STRUCTURE

BACKGROUND OF THE INVENTION

The present invention relates to an apparatus for accelerating a beam of charged particles, and more particularly to a four-finger RFQ linear accelerator ("linac").

Accelerators are used to accelerate charged particles, e.g., atomic sized particles (ions), to very high velocities. At high velocities, such particles may be considered as a "beam". Such beam exhibits significant energy that can advantageously be used for research, medical, industrial or military applications.

Early accelerators were massive machines that relied primarily on the generation and control of large magnetic fields. Unfortunately, the cost and size of such accelerators limited their application to research laboratories. Further, the available beam from such magnetically controlled devices was not focussed as narrowly as needed for many applications.

In the 1970's, two Russian scientists introduced a dramatically new concept for accelerating charged particles. Instead of relying on magnetic fields, this new concept accelerated the charged particles by subjecting them to high frequency alternating electric fields, established using four poles (or a quadrupole). Because the alternating electric fields were varied at radio frequency levels, the apparatus developed for practicing this new concept became known as the radio frequency quadrupole (RFQ) linear accelerator (linac).

The RFQ linac revolutionized, and continues to revolutionize, the field of accelerator physics. Compared to the complex, massive magnetic accelerators previously used, the RFQ linac is relatively simple in construction and operation, compact, lightweight and portable. It will accept large quantities of ions with low kinetic energies and accelerate them to much higher energies. Moreover, the beam accelerated by an RFQ linac is highly focused, due to the strong quadrupole electric field focusing that is used in such a device.

Even the RFQ linac, however, has its limitations. As explained more fully below, there is a limit to the acceleration that can be achieved with an RFQ linac while still maintaining a desired narrow (focused) beam. In all RFQ linac structures, the acceleration rate is inversely proportional to the particle velocity. At some point in the process of particle acceleration, the beam focusing performance drops to the point where some change in the acceleration process is desired. Unfortunately, in the conventional RFQ linac structure, e.g., using a four-vane or four-bar configuration, there are no changes that can be made to the basic structure to rectify the inherent deterioration of the beam focusing that occurs with higher velocities.

As a result, the RFQ linac has heretofore been generally limited to use as a pre-acceleration device, e.g. coupled to an ion source and used for accelerating the ions to a first velocity and energy, e.g.,2 MeV. When higher acceleration rates and kinetic energies are needed, more traditional acceleration devices, such as a magnetically focused drift tube linac (DTL), and/or a coupled cavity linac (CCL), have had to be employed. Unfortunately, in both the DTL and CCL structures, the accelerated beam expands appreciably due to the weaker magnetic focusing, thereby making the beam more susceptible to brightness-destroying emittance growth.

Some applications require a very intense focused beam of charged particles. Charged particle beam intensity is usually measured in units of amperes. Conventional four-vane linacs have typically been able to provide a beam intensity limited to around 100 milliamperes. To increase the beam intensity, it would be desirable to double the intensity of a single beam or otherwise combine two or more beams into a single beam. This concept (of doubling or combining charged particle beams) is referred to as "funneling". Unfortunately, the basic structure of a conventional four-vane or four-bar linac does not easily lend itself to funneling.

What is clearly needed, therefore, is an enhanced RFQ linac structure, i.e., an RFQ linac that extends the range of velocities and energies available from the device, and that permits funneling, all while preserving the ruggedness, compactness, focusing and simplicity features of prior RFQ linac devices. The present invention advantageously addresses these and other needs.

SUMMARY OF THE INVENTION

In accordance with one aspect of the present invention, a new RFQ linac structure is provided that offers enhanced performance at higher particle velocities and higher beam currents than practical for the conventional four-vane or four-bar RFQ linac structures. The new structure is similar to the conventional four-vane or four-bar structure in that it includes a series of increasingly longer accelerating gaps or cells through which a charged particle beam is focused and accelerated as a function of an RF electric field. The RF electric field is a quadrupole field, and alternates in sign from cell to cell. The quadrupole field focuses the charged particles to the center of the each cell. The alternating field also pushes the particles through each cell at a rate determined by the frequency of the field and the length of the accelerating cell.

The new structure differs from the conventional four-vane or four-bar RFQ linac structures in that it includes the use of four spaced-apart fingers in each accelerating cell of the linac. Two spaced-apart fingers protrude into the cell from one side of the cell so as to lie in a first plane. Two additional spaced-apart fingers protrude into the cell from the other side of the cell so as to lie in a second plane. The first and second planes are orthogonal. Hence, the spaced-apart fingers thus form a quadrupole. In a preferred embodiment, the spacing between each pair of fingers protruding into the cell increases as the distance into the cell increases.

In accordance with another aspect of the invention, the orientation of the four spaced-apart fingers from cell to cell represents an additional degree of freedom that allows the periodicity of the focal structure to be independent of the periodicity of the accelerating structure. This, in turn, makes it possible to double the rf frequency periodically to enhance the acceleration rate while holding the focusing strength constant. This serves to extend the useful range of the new RFQ linac structure by factors of, e.g., 4 in velocity and 16 in energy.

In accordance with yet another aspect of the invention, the new RFQ structure handles higher beam currents than previously possible. Further, the new structure readily lends itself to funneled linac systems where the frequencies and currents are doubled periodically in the funneling process., One embodiment of the invention may be characterized as a four-finger RFQ linac that includes:

(1) a plurality of increasingly longer accelerating cells, each of such plurality of accelerating cells having: (a) a first pair of spaced-apart fingers protruding into the center of the cell from a first end of the cell, the first pair of spaced-apart fingers lying in a first plane, and (b) a second pair of spaced-apart fingers protruding into the center of the cell from the other end of the cell, the second pair of spaced-apart fingers lying in a second plane that is perpendicular to the first plane;

(2) means for aligning the plurality of cells so that a charged particle beam may pass uninterrupted through all of the cells along a beam axis; and (3) means for selectively applying an alternating electric potential of a first frequency to the pairs of spaced-apart fingers so that the first pair of fingers in each cell assumes an opposite potential as the second pair of fingers. In operation, the application of such alternating electric field to the pairs of spaced-apart fingers causes a quadrupole electric field to be established in a region surrounding the pairs of fingers. This quadrupole electric field has a polarity that varies at a rate determined by the first frequency, and this quadrupole electric field serves to focus the charged particle beam towards the beam axis. However, the fingers in each cell are oriented in a prescribed pattern from cell to cell so as to provide a specified focusing periodicity. This focal periodicity is independent of the acceleration periodicity dictated by the particle wavelength, i.e., the distance a charged particle travels during each cycle of the first frequency. Thus, this focal periodicity provides an additional degree of freedom in the design of the four-finger linac.

Another embodiment of the invention may be characterized as an RFQ linac system. Such system includes at least one conventional RFQ linac operating at a first frequency for accelerating an ion beam to a first energy, e.g. 2 MeV, and a first four-finger RFQ linac operating at a second frequency for receiving the accelerated ion beam at the first energy from the conventional RFQ linac and accelerating the ion beam to a second energy. The second energy is four times as great as the first energy. Additional embodiments contemplate the addition of a second four-finger RFQ linac to further accelerate the ion beam to a third energy that is four times as great as the second energy, or sixteen times as great as the first energy.

Yet another embodiment of the invention may be characterized as a method of configuring the fingers of a four-finger RFQ linac so as to provide a focusing periodicity that is independent of an acceleration periodicity. Such a four-finger RFQ linac includes a plurality of cells, each having four-finger electrodes configured about a beam axis, and means for charging the four-finger electrodes with an alternating electric charge at a first frequency so as to establish a quadrupole electric field about the beam axis. The alternating quadrupole electric field within a given cell serves to focus a charged particle beam along the beam axis. Further, the alternating quadrupole electric field between adjacent cells serves to move a given charged particle within the charged particle beam from one cell to an adjacent cell at a rate determined by the cell width and the first frequency. The method of configuring the four-finger RFQ linac comprises the steps of: (a) increasing the width of the cells as the cells are positioned along the beam axis from an input end of the four-finger RFQ linac to an output end, the cell widths in combination with the first frequency of the quadrupole electric field comprising an accelerating structure periodicity; and (b) orienting the four-finger electrodes in a prescribed number of adjacent cells so as to provide a prescribed focusing periodicity, the prescribed focusing periodicity being independent of the accelerating structure periodicity.

It is a feature of the present invention to provide an RFQ linac that extends the useful range of beam particle velocity and energy beyond the capability of conventional four-vane or four-bar RFQ linacs, yet retains the desirable simplicity, focusing, ruggedness, and compactness features of a conventional RFQ linac. More particularly, it is a feature of the invention to provide such an RFQ linac that provides small diameter beams of protons having output energies extended to the range of 8 to 32 MeV.

It is a further feature of the invention to provide an improved RFQ linac structure wherein the sign of the quadrupole focussing action in each acceleration cell of the linac may be selectively controlled, thereby providing an additional degree of freedom in the design of the RFQ linac structure.

It is yet another feature of the invention to provide such an RFQ linac structure wherein it is possible to selectively have focal periods that are longer than the particle wavelength. It is a related feature of the invention to provide such an RFQ linac structure wherein the periodicity of the focal structure is independent of the periodicity of the accelerating structure.

It is an additional feature of the present invention to provide an RFQ linac structure that accommodates funneled beams at frequencies up to 1700 Mhz.

A further feature of the invention provides an improved RFQ linac structure that allows high space charge limits for the accelerated particles.

Still an additional feature of the invention provides an RFQ linac structure that is compatible with cryogenic operation.

BRIEF DESCRIPTION OF THE DRAWINGS

The above and other aspects, features and advantages of the present invention will be more apparent from the following more particular description thereof, presented in conjunction with the following drawings wherein.

DETAILED DESCRIPTION OF THE INVENTION

The following description is of the best mode presently contemplated for carrying out the invention. This description is not to be taken in a limiting sense, but is made merely for the purpose of describing the general principles of the invention. The scope of the invention should be determined with reference to the claims.

The present invention provides a new RFQ linac structure. However, it should be emphasized that the present invention is not viewed as a replacement of the conventional four-vane or four-bar RFQ linac. Rather, it is viewed as an extension of such conventional RFQ linac structures. Thus, the output beam from a conventional RFQ linac, e.g., a beam at 2 MeV, may be used as an input beam to the new RFQ linac structure of the present invention. The four-finger RFQ linac structure of the present invention, as described below, may then be used to increase the energy by, e.g., a factor of 4 to 16. Hence, the final output beam from the four-finger RFQ structure may be a beam of from 8 to 32 MeV.

The structure and operation of the four-finger RFQ linac of the present invention is best understood if the structure and operation of a conventional four-vane or four-bar RFQ linac is also understood. There are several references available in the literature that describe the construction and operation of a conventional four-vane or four-bar RFQ linac. See, e.g., Kapchinskiy, I. M., "History of RFQ Development", *The Institute for Theoretical and Experimental Physics*, 117259, Moscow (1984); Stokes et al., "The Radio-Frequency Quadrupole: General Properties and Specific Applications", Los Alamos Scientific Laboratory (1980); Jameson, R. A., "Introduction to RFQ Session", Los Alamos National Laboratory (1984); Schriber, S. O., "Present Status of RFQs", Los Alamos National Laboratory (1985); Staples, J., "RFQs in Research and Industry", Lawrence Berkeley Laboratory (1986); Schempp, A., "Recent Progress in RFQs", University of Frankfurt (1988). Only a very brief overview of the operation of a conventional RFQ linac will be presented herein. This overview is not intended to be a rigorous theoretical description of an RFQ linac. Rather, it is intended as a simple intuitive description. The reader is referred to the cited references, or equivalent references, for a more thorough and theoretical treatment of the RFQ linac.

Figure 1A:
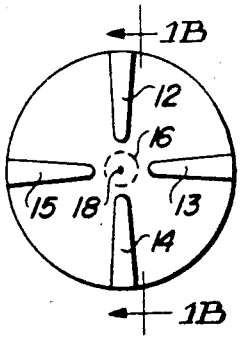
FIG. 1A (PRIOR ART)
FIG. 1A shows a cross section of a prior art four-vane RFQ linac.

In general, an RFQ linac uses a quadrupole electric field to both focus and accelerate charged particles. The quadrupole electric field is generated by applying an RF current to four spaced-apart electrodes. The orientation of the four poles is as shown in the end view of a four-vane structure shown in FIG. 1A, i.e. a quadrupole configuration. As seen in FIG. 1A, the poles are realized by four vanes 12, 13, 14 and 15, with a small opening or aperture 16 remaining in the center of the four poles. A beam axis 18 passes through the center the space 16. Opposite poles or vanes 12 and 14 are charged &:o the same polarity, as are opposite poles 13 and 15. The poles or vanes are scalloped with increasingly deeper and longer curves 20, as shown best in the sectional view of FIG. 1B.

Figure 1B:
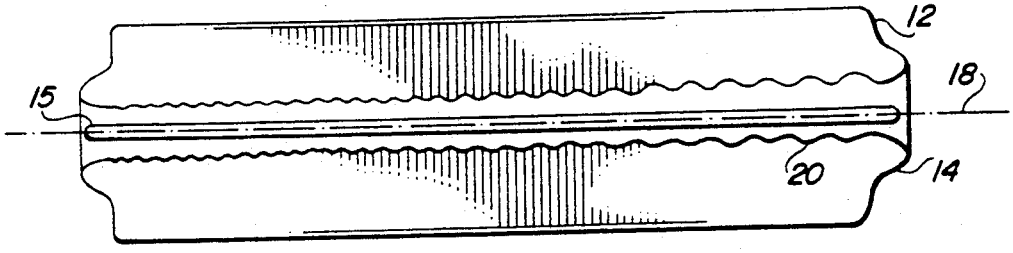
FIG. 1B (PRIOR ART)
FIG. 1B shows a sectional view taken along the line 1B—1B of FIG. 1A.
Figure 2:
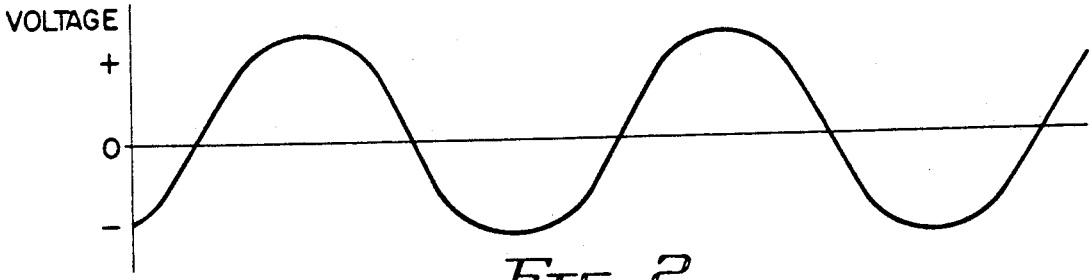
FIG. 2 illustrates an alternating voltage used to power an RFQ linac.

FIG. 2 illustrates an alternating voltage used to power an RFQ linac, such as the four-vane linac of FIGS. 1A and 1B. This alternating voltage will be used as a reference in the description of the focusing and accelerating functions presented below in connection with FIGS. 3A—3C and FIGS. 4A—4C.

Figure 3A:
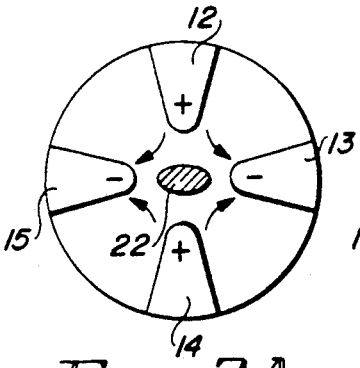
FIGS. 3A, 3B and 3C schematically illustrate how the quadrupole field of an RFQ linac achieves its focusing function, with FIG. 3A corresponding to those periods of time when the voltage in FIG. 2 is positive, FIG. 3B corresponding to those periods of time when the voltage in FIG. 2 is zero, and FIG. 3C corresponding to those periods of time when the voltage in FIG. 2 is negative.
Figure 3B:
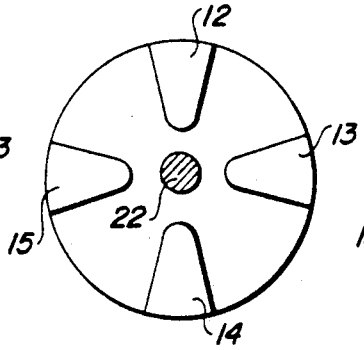
Figure 3C:
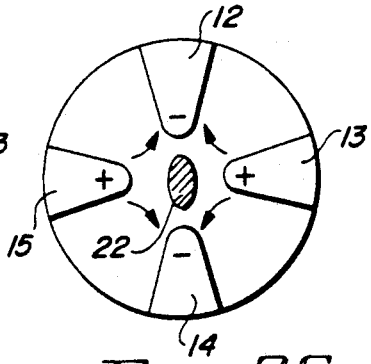

FIGS. 3A, 3B and 3C, which are intended to represent end views of the linac of FIG. 1, schematically illustrate how the quadrupole field of an RFQ linac achieves its focusing function. For example, in FIG. 3A, corresponding to those periods of time when the voltage in FIG. 2 is positive, the poles 12 and 14 are charged positively, and the poles 13 and 15 are charged negatively. Hence, at this time, a positively charged ion beam 22, e.g., a proton beam, located in the center space 16, tends to assume an oblong cross sectional shape (with the long axis of the oblong being between the negatively charged poles 13 and 15, and the short axis of the oblong being between the positively charged particles 12 and 14). This beam shape results because the positive ions are attracted towards the negatively charged poles 13 and 15, and are repelled away from the positively charged poles 12 and 14.

FIG. 3B corresponds to those periods of time when the current in FIG. 2 is zero. Hence, none of the poles are charged, and the ion beam 22 assumes a generally circular cross section shape. FIG. 3C corresponds to those periods of time when the current in FIG. 2 is negative. Hence, poles 12 and 14 are charged negatively during this time, and poles 13 and 15 are charged positively. Thus, the ion beam 22 assumes an oblong cross sectional shape (with the long axis of the oblong being between the negatively charged poles 12 and 14, and the short axis of the oblong being between the positively charged particles 13 and 15).

In this manner, the charged particles are confined to the small area within the aperture 16 between the poles. While the overall cross sectional shape of the beam oscillates between an oblong of one orientation to an oblong rotated 90 degrees, it will be appreciated that the aperture 16 between the poles is very small, e.g., on the order of 5 mm in diameter, and the beam diameter is focused to an area even smaller than this space, e.g. on the order to 2 mm in diameter. Hence, the ion beam 22 is focused to a very narrow beam.

Figure 4A:
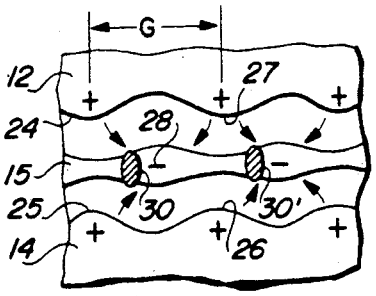
FIGS. 4A, 4B and 4C schematically illustrate how the quadrupole field of an RFQ linac achieves its accelerating function of moving the charged particle from one accelerating cell to the next, with FIG. 4A corresponding to those periods of time when the voltage in FIG. 2 is positive, FIG. 4B corresponding to those periods of time when the voltage in FIG. 2 is zero, and FIG. 3C corresponding to those periods of time when the voltage in FIG. 2 is negative.
Figure 4B:
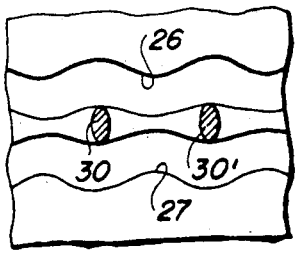
Figure 4C:
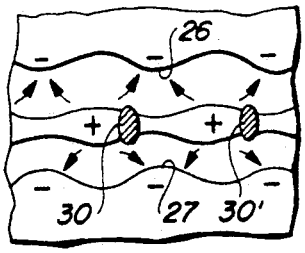

FIGS. 4A, 4B and 4C schematically illustrate how the quadrupole field of a four-vane RFQ linac achieves its accelerating function. These figures show a small portion of a side view of the four-vane RFQ linac. Only three of the vanes are visible in the figures, vanes 12 and 14 (lying in the plane of the paper) and vane 15 (lying in a plane perpendicular to the paper). Vane 13 has been removed for clarity. As described above, the edges of the vanes are scalloped. The peaks of the perpendicular vanes are offset. Hence, a first peak 24 of the vane 14 is opposite a similar peak 25 of the vane 12 in the same plane. A second peak 26 of the vane 14 is likewise opposite a similar peak 27 of the vane 12. But a peak 28 of the vane 15 is offset from the peaks 24 and 26, so as to be midway between these peaks.

The region between adjacent peaks of one set of vanes or poles, e.g., the region G between vane peaks 24 and 26, may be considered as an acceleration gap or cell through which a charged particle is accelerated. Acceleration occurs as shown in the sequence of FIGS. 4A through 4C. In FIG. 4A, corresponding to those periods of time when the current in FIG. 2 is positive, the peaks 24 and 26 of the vane 14 (as well as the corresponding peaks 25 and 27 of the vane 12) are positively charged. Hence, a positively charged ion (or a packet of positive ions) 30, moving left to right in the figure (because of its initial kinetic energy) is repelled away from the positively charged pole peaks 24 and 25, and is attracted towards the negatively charged pole peak 28. A similar process occurs relative to the packet of ions 30'. As the ion particle or packet 30 approaches the negatively charged pole peak 28, the charge thereon goes to zero, corresponding to those periods of time when the current in FIG. 2 is zero, as shown in FIG. 4B. Thus, the momentum of the particle or packet 30 continues to move it left-to-right through the acceleration cell or gap G. As it continues to move, the charge on the pole peak 28 becomes positive, and the charge on the pole peaks 26 and 27 becomes negative. Hence, the charged ion packet 30 is repelled away from the pole peak 28 and towards the pole peaks 26 and 27. In this manner, the changing quadrupole electric field propels the charged particles or packets 30 and 30' through each acceleration cell or gap.

Figure 5:
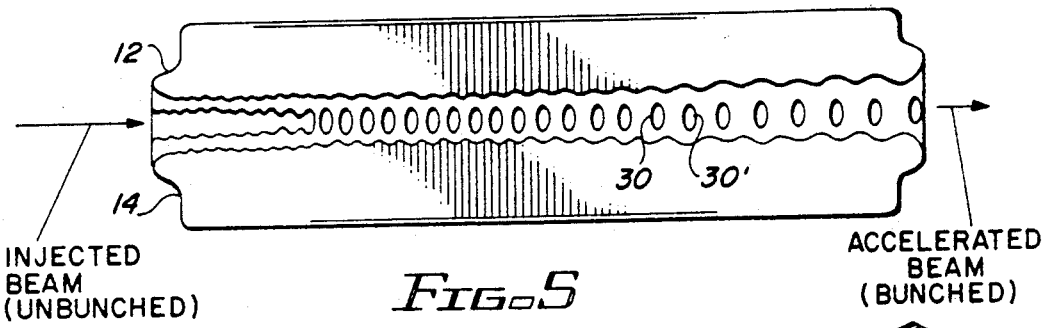
FIG. 5 shows a lengthwise sectional view of a prior art four-vane RFQ linac, and illustrates how the tip of the vanes are scalloped with increasingly deeper and longer curves, thereby gradually changing the spacing or length of each acceleration cell or gap.

The time required for the charged packets 30 and 30' to traverse an acceleration cell or gap G is the time it takes the voltage applied to the poles to reverse its polarity, i.e., one half period of the voltage waveform shown in FIG. 2. Said another way, two accelertion cells or gaps, as defined above, will be traversely by a charged particle in one period of the charging voltage waveform. This distance is known as the particle wavelength. Thus, by maintaining a fixed frequence of the voltage waveform used to charge the vanes or poles of the RFQ accelerator, and by gradually increasing the length of the acceleration cells or gaps (i.e., by gradually increasing the spacing between the pole peaks of each vane), as shown in FIG. 5, the particle wavelength is increased and the charged particles or packets traverse an increasingly longer distance in fixed time increments as the packets move from left-to-right through the accelerator. In this manner, the charged particle beam is accelerated through the RFQ linac.

Unfortunately, as marvelous and great as the four-vane or four-bar RFQ linac is for accelerating charged particle beams, it is not without its limitations. This is because of the inter-relationship inherent in a conventional RFQ linac between the quadrupole focusing action and the quadrupole acceleration action. More particularly, in a conventional four-vane RFQ, it can be shown that the acceleration rate, $A_r$, and the focussing strength, $F_s$, are proportional to $$A_r \propto \frac{E_s r_0}{\beta\lambda} \tag{1}$$

$$F_s \propto \frac{E_s \lambda^2}{(M/Q) r_0}. \tag{2}$$

In Equations ( 1 ) and ( 2 ), the term $E_s$ represents the surface electric field, $r_0$ represents the radius (or spacing) of the vane tip (e.g., the spacing between adjacent pole peaks of the scalloped vane tip), $\beta\lambda$ is the particle wavelength, and M/Q is the mass to charge ratio of the particles in the beam.

As can be seen from Equations ( 1 ) and ( 2 ), once the field strength $E_S$ has reached its maximum value, there is a limit to the spacing between the poles, $r_0$, that may be used to increase the acceleration without significantly affecting the focussing strength. That is, as the pole distance increases, the focussing strength decreases. Further, if the frequency is increased in attempt to improve the acceleration rate, the focussing strength decreases. The other parameters included in Equations ( 1 ) and ( 2 ) are usually fixed for a given application, e.g., M, Q and $\beta$ are not variables that can readily be changed. Thus, a limit is quickly reached beyond which the performance of the conventional RFQ linac cannot be improved.

Figure 6B:
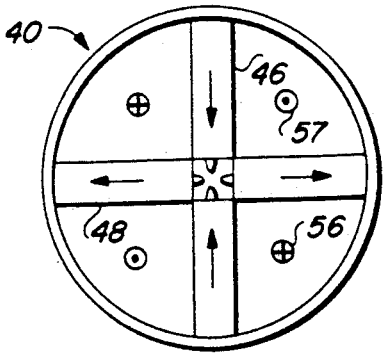
FIG. 6B is an end view of one of the acceleration cells of FIG. 6A.
Figure 6A:
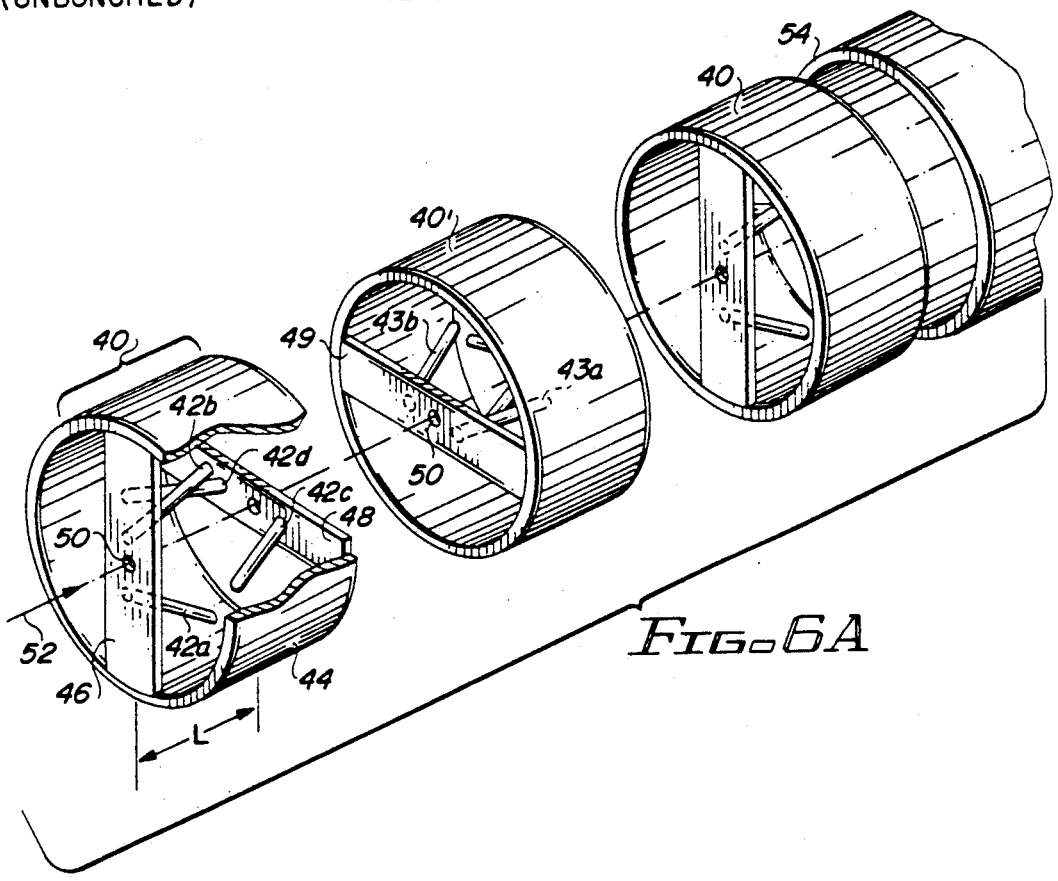
FIG. 6A shows an exploded view of one embodiment of a four-finger RFQ linac made in accordance with the present invention, showing a preferred construction for the individual acceleration cells used within such linac.

In order to add another degree of freedom to the RFQ linac design, the present invention utilizes a plurality of four-finger acceleration cells 40 as shown in FIG. 6A. Each cell 40 includes appropriate support structure for supporting four spaced-apart fingers **42*a*,, 42*b*, 42*c* and 42*d*. Two of the fingers, 42*a*, and 42*b*, protrude into the center on the cell 40 from a first end of the cell. The other two fingers, 42*c* and 42*d*, protrude into the center of the cell from the other end of the cell 40. In order to form a symmetrical quadrupole, the two fingers 42*a*, and 42*b* lie in a first plane. The two fingers 42*c* and 42*d* lie is a second plane that is orthogonal or perpendicular to the first plane. As the fingers 42*a*, and 42*b* protrude into the center of the cell 40, the spacing between these two fingers increases. Similarly, as the fingers 42*c* and 42*d* protrude into the center of the cell 40**, the spacing between these two fingers also increases.

The preferred support structure used to support the fingers **42*a*, and 42*b* includes a cylindrical shell 44 to which a crossbar 46 is attached at one end and a crossbar 48 is attached at the other end. The crossbars 46 and 48 have a length equal to the diameter of the cylindrical shell 44 and pass from one side of the shell wall to the other side of the shell wall in a straight line. The longitudinal axes of the crossbars 46 and 48 are orthogonal. An aperture 50 is located in the center of each crossbar 46 and 48 through which a beam axis 52 passes. The aperture 50 has a diameter sufficiently large to allow a charged particle beam to pass therethrough. The fingers 42*a*, and 42*b* have one end secured to the crossbar 46. Similarly, the fingers 42*c* and 42*d* have one end secured to the crossbar 48**.

In order to configure a plurality of acceleration cells 40 in a four-finger linac made in accordance with the present invention, the individual cells are inserted into a support tube 54. Adjacent individual cells are oriented such that back-to-back crossbars, e.g., crossbar 48 of cell 40 and crossbar 49 of cell 40', are of the same orientation, i.e., the longitudinal axes. During fabrication, each cell 40 is cooled and shrunk-fit into the tube 40, with the fingers of each cell being configured and aligned at the interface of each cell to a specified pattern, as described below. Advantageously, the cells make good thermal contact with the support tube 54, which support tube may include cooling means, as needed. The individual four-finger cells, however, are cooled by conduction through their thermal contact with the support tube.

Electrical contact with each of the fingers is made through the support structure. That is, in a preferred embodiment, the crossbars 46 and 48 are conductive, as are the fingers **42*a*–42*d*. An alternating voltage of a first polarity is applied to the crossbar 46 at the same time that the opposite polarity of this same alternating voltage is applied to the crossbar 48. Thus, at a time when the fingers 42*a*, and 42*b* are positively charged, the fingers 42*c* and 42*d* are negatively charged, and vice versa. Back-to-back cross bars of adjacent cells 40** are of the same polarity.

At lower frequencies of operation, the wall of the cylindrical shell 44 must either be non-conductive, or have a nonconductive region therein to prevent the fingers **42*a*, and 42*b* from being electrically shorted out to the fingers 42*c* and 42*d*. At higher frequencies, however, the crossbars 46 and 48, as well as the wall of the cylindrical shell 44, may all be conductive, with these conductive elements functioning as an inductor, and with the spaced-apart finger pairs 42*a*/42*b*, and 42*c*/42*d***, functioning as electrodes of a capacitor, as in an LC resonant circuit.

It is interesting to note, as shown in FIG. 6B, which is an end view of one of the acceleration cells 40 shown in FIG. 6A, that each cell of the four-finger crossbar structure is bounded by planes of transverse electric (TE) symmetry. That is, using conventional waveguide nomenclature, at the boundaries of each acceleration cell, $E_z=0$ (with the z axis being in the direction of the beam axis) and $H_r=H_0=0$. Thus, when operating in a resonant cavity mode, i.e., when the conductive crossbar and shell wall and fingers function as a resonant LC circuit, as described above, the crossbar involves no electric fields or currents that cross the boundary of the cell. Rather, the currents flow radially through the crossbars as shown in FIG. 6B. The magnetic fields, represented by a + symbol 56 or a dot 57 in FIG. 6B, are normal to these cell boundaries and alternate in direction between adjacent quadrants. The cells are transformer coupled to one another by these longitudinal magnetic fields. Advantageously, the dipole mode, which may be a serious problem in the four-vane RFQ structure, is shorted out by the crossbars in the four-finger structure shown in FIGS. 6A and 6B.

Figure 7:
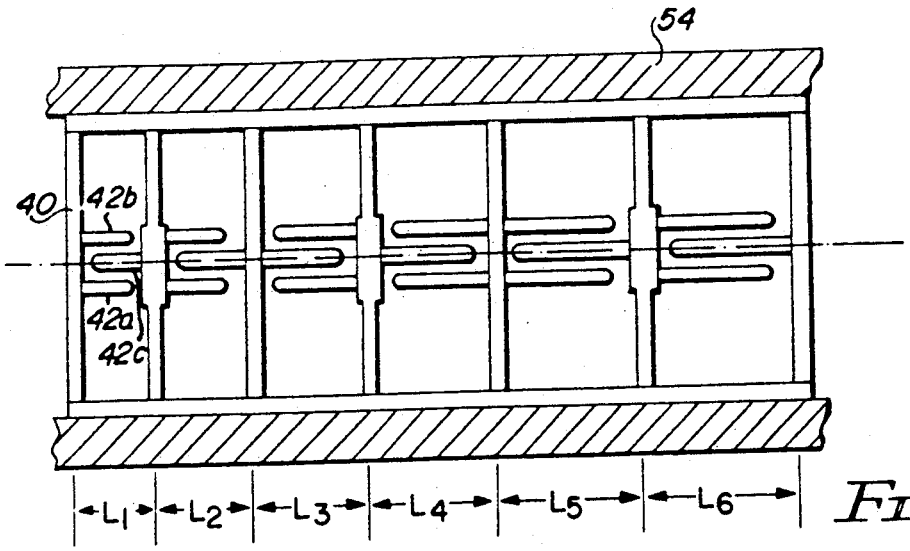
FIG. 7 shows a side sectional view of a portion of a four-finger RFQ linac made from a plurality of increasingly longer RFQ cells.

Referring next to FIG. 7, a schematic side sectional view of a portion of a four-finger RFQ linac made in accordance with the present invention is shown. Six cells are included in FIG. 7. The length of each cell is $L_n$, where n is an integer representing a particular cell. The individual cells each have an increasingly longer length $L_n$ as they are positioned closer to the output side of the linac. This increasing length forces the charged particles in the beam to move through a longer distance in the same amount of time (as controlled by the operating frequency) in the same manner as described above in connection with the four-vane RFQ linac. The acceleration rate $A_r$ for the four-finger linac may thus be described the same as was the case for the four-vane linac. That is, $$A_r(\text{four-finger}) \propto \frac{E_s r_0}{\beta\lambda} \tag{3}$$

where $E_s$ is the surface field, $r_0$ is the median spacing between the fingers of opposite polarity, and $\beta\lambda$ is the particle wavelength. However, unlike the four-vane (or equivalent) structures, the four-finger structure of the present invention may utilize a periodicity of the focal structure that is independent of the periodicity of the accelerating structure. That is, for synchronous acceleration, and as indicated above in Equation (3 ), the length of one period of the accelerating structure must be equal to the particle wavelength, $\beta\lambda$. Let $N\beta\lambda$ be the length of one period of the focusing structure. In the four-vane or four-bar structures of the prior art, N is constrained to unity. In the four-finger structure, however, N can be selected to have any positive value, although (as well be seen from the description that follows) it is generally preferred that N take on integer values in order to provide for more regular structures.

Figure 8A:
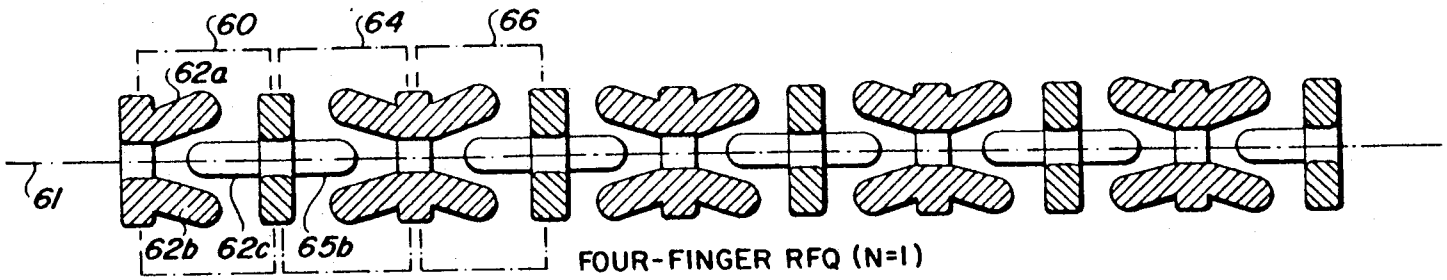
FIGS. 8A, 8B and 8C illustrate how the orientation of the fingers of each cell may be altered in order to provide an additional degree of freedom in designing an RFQ linac in accordance with the present invention.
Figure 8B:
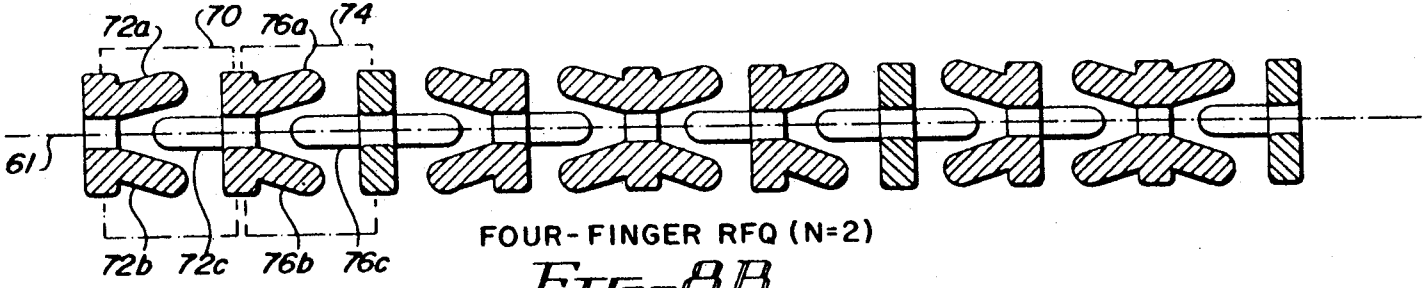
Figure 8C:
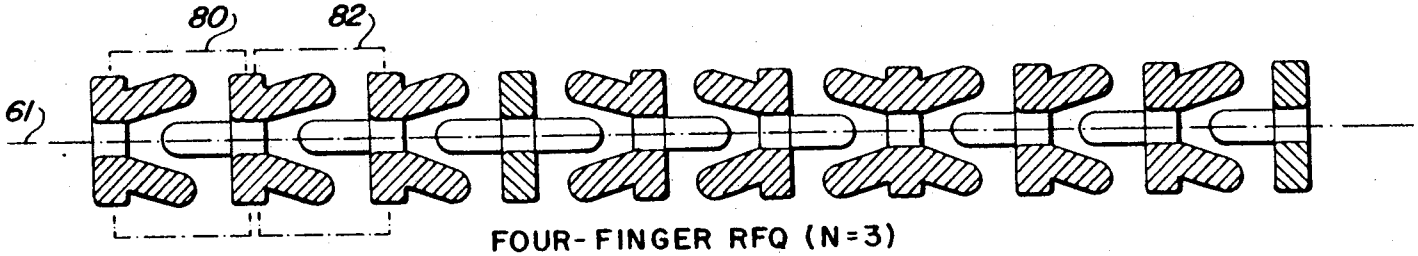

The four-finger structure of N=1, 2, and 3 is shown in the sectional diagrams of FIGS. 8A, 8B and 8C, respectively, with the section being taken down the center of the linac structure. (Hence, both fingers in a vertical plane are shown, whereas only one finger in a horizontal plane is shown). These figures show the finger structures as viewed from a side sectional view of the four-finger linac structure, with the input beam originating, e.g., on the left, and the output beam exiting of the right along a beam axis 61. For clarity, the increasing lengths of the cells are not shown in FIGS. 8A, 8B or 8C. However, it is to be understood that the cell lengths do increase from left to right as shown, e.g., in FIG. 7.

Any means may be used, of course, to support the four fingers used in each acceleration cell. The preferred means is as shown in FIG. 6A above, using a cylindrical shell with orthogonal crossbars on each end. It is significant, as shown in FIG. 6A, that the crossbars of adjacent cells that are back-to-back, e.g., crossbar 48 of cell 40 and crossbar 49 of cell 40', must be oriented the same. That is, as shown in FIG. 6A, the crossbar 48 of cell 40 and the back-to-back crossbar 49 of the adjacent cell 40' are both horizontal. However, the fingers **42*c* and 42*d* attached to crossbar 48 lie in a horizontal plane, yet the fingers 43*a* and 43*b* attached to crossbar 49** lie in a vertical plane, as required for the particular finger pattern being used.

The boundaries of the individual cells, such as the cell 40 shown in FIG. 6A, are shown by the dashed lines in FIGS. 8A, 8B, and 8C. Thus, for example, with reference to FIG. 8A, it is seen that a first cell 60 includes two fingers **62*a*, and 62*b* on the left that protrude into the center of the cell 60 in a vertical plane. Similarly, two fingers 62*c* and 62*d* (only one of which is seen in the sectional view of FIG. 8A) protrude into the center of the cell 60 from the right side of the cell in a horizontal plane. In an adjacent cell 64, two fingers 65*a* and 65*b* (only one of which is seen in the sectional view) protrude into the center of the cell 64 from the left side in a horizontal (H) plane, and two fingers protrude into the center of the cell 64 from the right side in a vertical (V) plane. Similarly, in the next adjacent cell 66, two fingers on the left of the cell 66 protrude into the cell 66 in a vertical (V) plane, and two fingers on the right of the cell 66 protrude into the cell 66 in a horizontal (H) plane. This pattern continues, with the fingers on the left side of the cell alternating between being positioned in a V plane or being positioned in an H plane along the length of the linac. For comparison purposes, it is helpful to define the finger pattern in FIG. 8**A as a V, H, V, H, V, H, . . . pattern, where the letters refer to the plane in which the fingers on the left side of each cell protrude into the cell. (It is understood, of course, that the fingers on the right side of each cell must protrude into the cell in the opposite plane.)

Back-to-back fingers are charged, at any instant of time, to the same charge or polarity. That is, the fingers 62*c* and 62*d* are charged to the same charge as are fingers 65*a* and 65*b*. Said another way, for the configuration shown in FIG. 8A, the fingers in a horizontal plane are charged to the same charge, and the fingers in a vertical plane are charged to the same charge (opposite of the charge of the fingers in the H plane).

One can clearly see the similarity between the four-finger structure shown in FIG. 8A and the four-vane structure shown, e.g., in FIGS. 1B or 4A–4C. In fact, there is little difference in performance between the four-vane structure of FIG. 1B and the N=1 four-finger structure shown in FIG. 8A. However, it is the structures for N>1 that are unique to the present invention, and that provide an additional degree of freedom heretofore unavailable.

Referring next to FIG. 8B, the finger orientation for a condition of N=2 is illustrated. As seen in FIG. 8B, a first cell 70 includes two fingers 72*a*, and 72*b* on its left side that protrude into the cell cavity in a vertical (V) plane. Thus, two fingers 72*c* and 72*d* protrude into the cell 70 from its right side in a horizontal (H) plane. Similarly, an adjacent cell 74 includes two fingers 76*a* and 76*b* on its left side that protrude into the cell cavity in a vertical (V) plane. Two additional fingers, 76*c* and 76*d* protrude into the center of the cell 74 from its right side. Thus, using the pattern description used above in FIG. 8A (where the plane of the fingers protruding into the cell from the left side is represented by a letter H or V depending upon whether the fingers are in a horizontal or vertical plane), it is seen that the pattern of the finger orientation shown in FIG. 8B is, starting with cell 70 on the left, V, V, H, H, V, V, H, H, . . . . Note also, that as is the case with all the finger configurations, back-to-back fingers are of the same polarity. Thus, e.g., the horizontal fingers 72*c* and 72*d* of cell 70 are of the same polarity as are the vertical fingers 76*a* and 76*b* of the adjacent cell 72.

Referring next to FIG. 8C, the finger orientation for a condition of N=3 is illustrated. It is seen that the finger pattern may be described, starting with cell 80 on the left, and using the same pattern description as used above in FIGS. 8A and 8B, as a V, V, V, H, H, H, V, V, V, H, H, H, . . . pattern.

The significance of the finger configurations for N>1 is that the periodicity of the focusing structure becomes independent of the periodicity of the accelerating structure. Thus, as a charged particle (or packet of charged particles) moves through the cells 70 and 74 of FIG. 8B, for example, such particles (from an accelerating point of view) are moved from one cell to the next as described above in connection with the four-vane structure. However, from a focusing point of view, such particles are focused differently. This is because, for example, the combined charge on the fingers 72*a*, 72*b*, 72*c* and 72*d* in the cell 70 tends to focus the beam in one orientation (e.g., to exert electrical forces on the beam that tend to make it, when viewed in cross section, oblong). By the time the beam particles have moved to the next cell 74, the polarity of the fingers 76*a*, 76*b*, 76*c* and 76*d* has changed so as to continue to focus the beam in the same orientation as in the cell 70 (i.e., to continue to exert electrical forces on the beam that make in oblong in the same direction as in cell 70). Intuitively, one may think this is bad, because the beam may tend to be flattened too much. However, advantageously, the frequency of the driving signal (that controls the polarity changes on the fingers) when using the N=2 configuration of FIG. 8B may be twice as great as the frequency used for the N=1 configuration. Hence, the beam particles are accelerated through a cell twice as fast as in FIG. 8A, and the sideways focusing forces (that tend to make a cross section of the beam oblong) are exerted for the same period of time as they are for the configuration shown in FIG. 8A.

This concept is readily seen from the mathematical representation of the focusing strength, $F_s$ for the four-finger structure. The focusing strength for a four-finger configuration for N>1 is proportional to $$F_s(\text{four-finger}) \propto \frac{E_s N^2 \lambda^2}{(M/Q) r_0}. \tag{4}$$

Note, that Eq. (4) is the same as Eq. (2 ) above (for the four-vane case) except for the presence of the term $N^2$ in the numerator. Advantageously, N thus represents an additional parameter that can be used to maintain a desired focusing strength while increasing the acceleration rate.

Hence, using the four-finger RFQ structure of the present invention, it is possible to double the frequency and the N value, simultaneously, in order to double the acceleration rate while holding the focusing strength constant. Thus, the four-finger RFQ structure may extend the performance of the RFQ by a factor of two in velocity and a factor of four in energy. In many instances, it would also be possible to double the frequency and N value a second time, thereby leading to an extension of the RFQ energy by a factor of 16.

Figure 9:
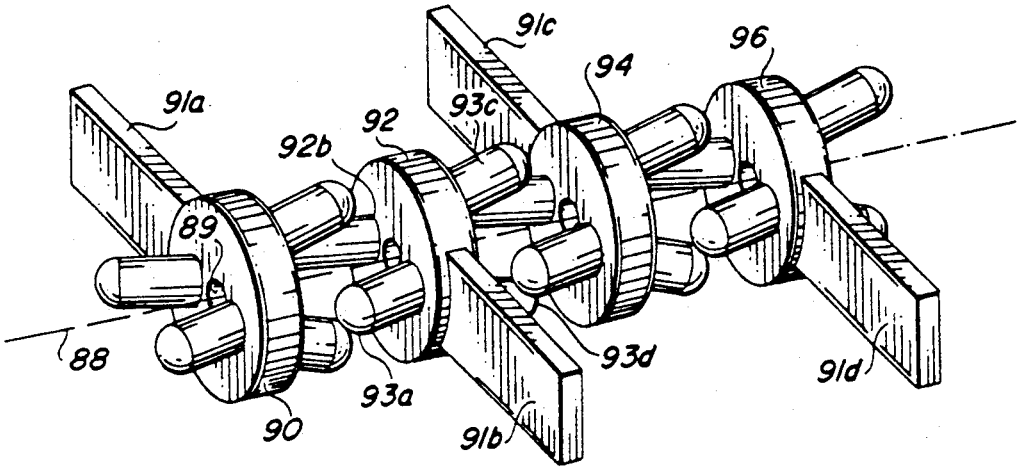
FIG. 9 schematically shows an alternative RFQ linac structure.

Referring next to FIG. 9, a portion of an alternative embodiment of the four-finger RFQ linac of the present invention is schematically depicted. This embodiment includes a plurality of support disks 90, 92, 94 and 96, each with a pair of spaced-apart fingers protruding out from each side of the respective support disk. For example, fingers 93*a* and 93*b* protrude out from the left side of support disk 92 in a horizontal plane (as viewed in the figure), while fingers 93*c* and 93*d* protrude out from the left side of the support disk 92 in a vertical plane. Each support disk has an aperture 89 in its center through which a beam axis 88 passes. Each support disk also includes a bar 91*a*, 91*b*, 91*c*, and 91*d*, or equivalent, for making electrical contact with each disk and its respective fingers. The embodiment shown in FIG. 9 is particularly well suited for use at lower frequencies, where an external inductor (not shown) is connected in series with the disk/finger (capacitive) combinations in order to form an LC circuit that oscillates at a suitable frequency to accelerate heavier charged particles, e.g., dust particles, to high velocities. Note that the finger configuration shown in FIG. 9 is for N=4 or greater.

Thus, in summary, it is thus seen that the four-finger RFQ structure of the present invention allows the orientation of the fingers about the beam axis to determine the sign of the quadrupole focusing action, thus yielding an additional degree of freedom in the design of RFQ linacs. In particular, with this structure, it is possible to have periods in the focusing structure that are longer than the particle wavelength.

During operation of the four-finger RFQ linac structure, the beam passes through a series of electrodes that alternate in polarity and are spaced by one half of the particle wavelength. A cell of the structure is defined as the region between the centers of adjacent electrodes. Each electrode has two fingers extending into the cell creating a strong transverse quadrupole component to the electric field in the cell. The strongest focusing fields occur near the centers of the cells.

At very low frequencies, the four-finger RFQ linac takes the form of an interdigital structure (e.g., FIG. 9) where alternate electrodes are attached to one of two common support rods forming the capacitor of a resonant circuit involving a large, external, multiturn inductor.

At intermediate frequencies, alternate electrodes are attached to one of two support frames forming the capacitor of a resonant circuit, where the inductor is internal to, e.g., a vacuum enclosure where the RFQ is placed, and involves the support legs for the support frames.

At higher frequencies, where resonant cavity sizes penetrate the four-finger RFQ takes the form of a cross-bar cavity resonator. This structure comprises a cylindrical cavity, loaded with transverse bars, alternating in orientation by 90 degrees and spaced at half of the particle wavelength. The bars have a hole on axis through which a beam may pass. A cell is defined again as the region between the centers of adjacent bars. Each bar has two fingers extending into the cell creating a strong transverse quadrupole component to the electric field in the cell. The strongest focusing fields occur near the centers of the cells.

Figure 10:
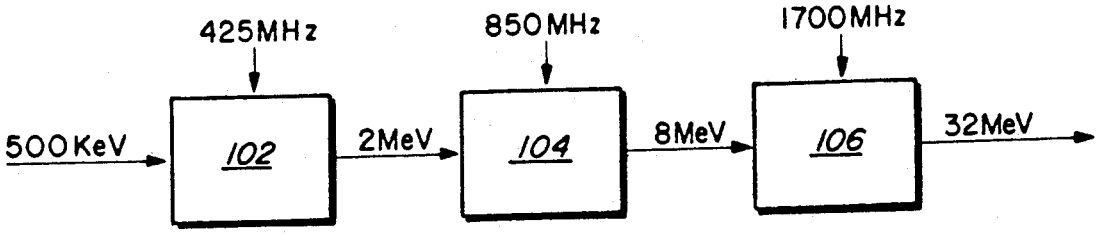
FIG. 10 is a block diagram of an RFQ linac system illustrating how several RFQ linacs may be combined to produce a desired high energy output beam.

Advantageously, the four-finger RFQ linac of the present invention lends itself for "funneled" linac systems where the frequencies are doubled periodically to accommodate the funneling process. Such a funneled system is shown in the block diagram of FIG. 10. In FIG. 10, a first RFQ linac 102 receives an input beam of 500 KeV and accelerates it to 2 MeV using a frequency of 425 MHz. This first RFQ linac 102 may be a conventional four-vane linac or a four-finger linac having N=1.

Still referring to FIG. 10, the 2 MeV output from the first linac 102 is used as the input to a second linac 104. This second linac operates at double the frequency of the first linac 102, e.g., at 850 MHz. The output beam from the second linac is 8 MeV. The second linac 104 is preferably a four-finger linac with N=2 as described herein.

The 8 MeV output from the second linac 104 may then be used as the input to a third linac 106. The third linac 106 operates at double the frequency of the second linac, i.e., 1700 MHz. The energy of the beam is increased in the third linac 106 by a factor of four, i.e., to 32 Mev. The third linac 106 is also a four-finger linac with N=2 as described herein.

Representative design parameters associated with the second RFQ linac 104 and the third RFQ linac 106 are as described below in Table 1.

TABLE 1

| Parameter | LINAC 104 8 MeV | LINAC 106 32 MeV |
|---|---|---|
| Frequency | 850 MHZ | 1700 MHz |
| Energy (Input) | 2.0 MeV | 8.0 MeV |
| Energy (Output) | 8.0 MeV | 32.0 MeV |
| Surface Fields | 2.0 Kilpatrick | 2.0 Kilpatrick |
| Aperture Radius | 2.5 mm | 2.5 mm |
| Beam Radius | 1.0 mm | 1.0 mm |
| Current Limit | 291 mA | 734 mA |
| Length | 2.1 m | 6.3 m |
| Total Weight | 42 kg | 73 kg |

It is noted that the surface electric fields listed in Table 1 include an enhancement factor of 1.4. Further, the beam emittance used in these designs corresponds to six times the normalized rms emittance of 0.02 cm-mrad. The total weight is for the structure shrunk into a thick-walled (0.5 inch) aluminum tube.

Figure 11:
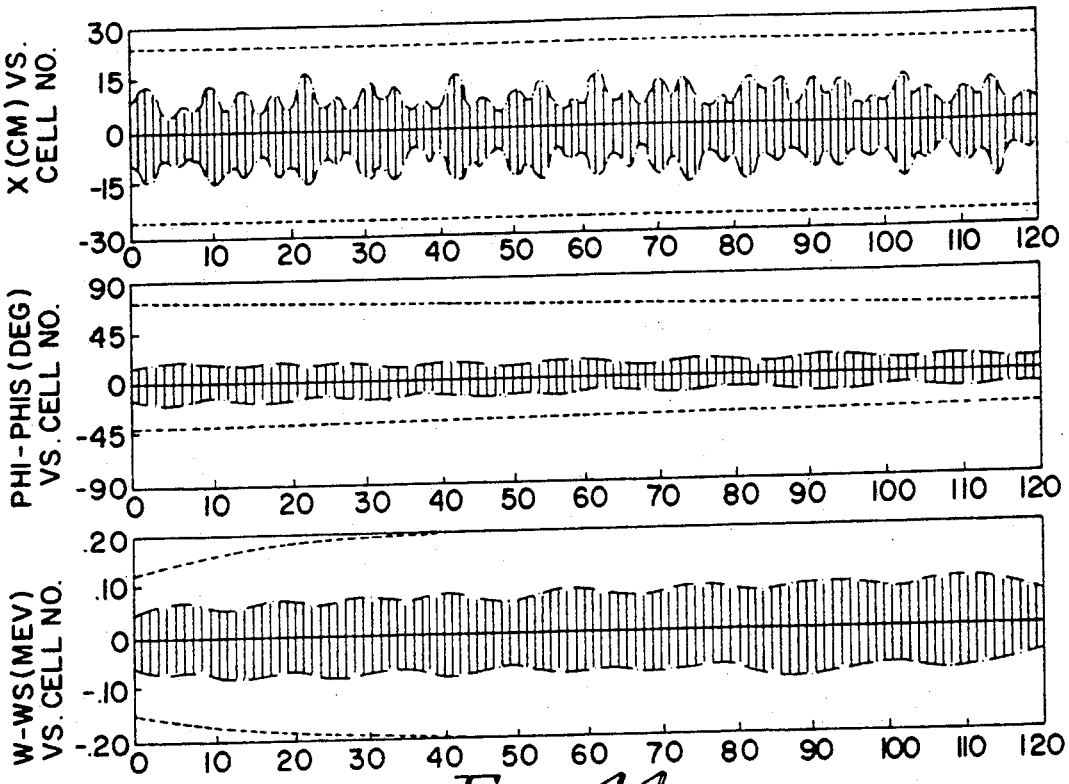
FIG. 11 shows computer-generated beam profiles for a 2-8 MeV RFQ linac modeled in accordance with the present invention.

Some further parameters associated with the design of the linac 104 are shown in Table 2. These parameters assume a finger configuration of N=2, as shown in FIG. 8B. The output transverse and longitudinal beam profiles for the linac described in Table 2 are shown in FIG. 11. In FIG. 11, the horizontal axis represents the cell number. Thus, as seen in FIG. 11, the design of the linac 104 utilizes 120 cells.

TABLE 2

Four-Finger Cross-Bar RFQ - 8 MeV

| | | |
|---|---|---|
| PARTICLE: | MASS: | 1.0070 AMU |
| | WZERO: | 938.0221 MeV |
| | CHARGE: | 1.0000 Proton charges |
| STRUCTURE: | TYPE: | FOUR-FINGER CAVITY N = 2 |
| | FREQ: | 850.0000 MHz |
| | WAVELENGTH: | 35.2697 cm |
| | APERTURE: | 0.2500 cm |

| ENERGIES AND VELOCITIES: | | W (MeV) | V (km/s) | B*L (cm) | BETA |
|---|---|---|---|---|---|
| INITIAL: | | 2.000 | 19576.912 | 2.303 | 0.065302 |
| SHAPER: | PHIS | 2.000 | 19576.912 | 2.303 | 0.065302 |
| BUNCHER: | −35 | 2.000 | 19576.912 | 2.303 | 0.065302 |
| FINAL: | −30 | 8.000 | 39153.824 | 4.606 | 0.130603 |

| | | |
|---|---|---|
| EXCITATION: (Kappa = 1.4) | VOLTAGE: | 97.3687 kv |
| | E (SURFACE): | 54.5265 MV/m |
| | BRAVERY: | 2.0000 — |
| BEAM CURRENT: | ELECTRICAL: | 50.0000 mA |
| | PARTICLE: | 50.0000 mA |
| | EMITTANCE (N): | 0.0050 cm-mrad |

TABLE 2-continued

| Four-Finger Cross-Bar RFQ - 8 MeV | | | |
|---|---|---|---|
| BEAM PULSE: | LENGTH: | 100.0000 | microseconds |
| | REP. RATE: | 60.0000 | Hz |
| | DUTY FACTOR: | 0.6000% | |
| FACTORS: | MODULATION (BUNCHER): | 3.0000 | — |
| | FOCUSING STRENGTH (EFF): | 8.2640 | — |
| | ACCELERATING EFFICIENCY: | 0.7643 | — |
| | FOCUSING EFFICIENCY: | 0.2164 | — |
| | CAPTURE: | 100.00% | |
| LIMITS: | BEAM CURRENT (TRANSVERSE): | 749.4102 | mA |
| | BEAM CURRENT (LONGITUDINAL): | 291.2843 | mA |
| LENGTHS: | LR = 0.0 LS = 0.0 LG = 0.0 LA = 212.4 LTOT = 212.4 | | |

Figure 12:
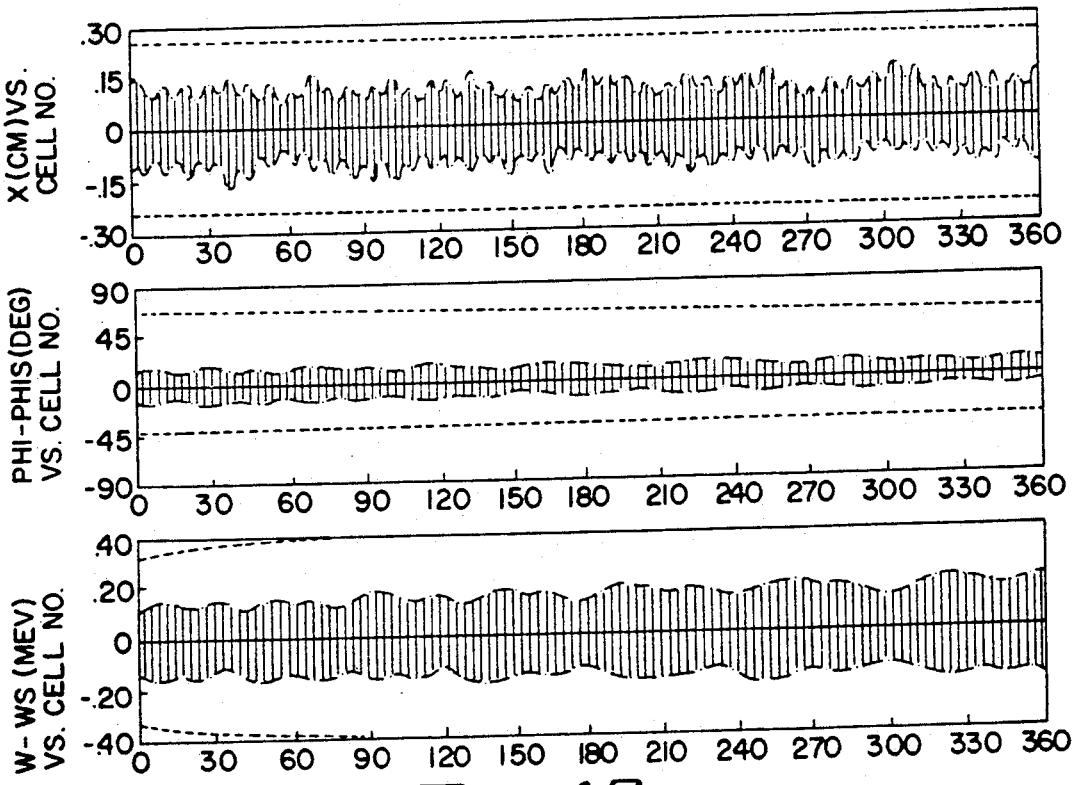
FIG. 12 shows similar computer-generated beam profiles for an 8-32 MeV RFQ linac modeled in accordance with the present invention.

Similarly, some further parameters associated with the design of the linac 106 are shown in Table 3. These parameters also assume a finger configuration of N=2. The output transverse and longitudinal Beam profiles for the linac described in Table 3 are shown in FIG. 12.

TABLE 3

| Four-Finger Cross-Bar RFQ - 32 MeV | | | | | | |
|---|---|---|---|---|---|---|
| PARTICLE: | MASS: | | 1.0070 AMU | | | |
| | WZERO: | | 938.0221 MeV | | | |
| | CHARGE: | | 1.0000 Proton charges | | | |
| STRUCTURE: | TYPE: | | FOUR-FINGER CAVITY N = 4 | | | |
| | FREQ: | | 1700.0000 MHz | | | |
| | WAVELENGTH: | | 17.6349 cm | | | |
| | APERTURE: | | 0.2500 cm | | | |
| ENERGIES AND VELOCITIES: | | | W (MeV) | V (km/s) | B*L (cm) | BETA |
| INITIAL: | | | 8.000 | 39153.824 | 2.303 | 0.130603 |
| SHAPER: | PHIS | | 8.000 | 39153.824 | 2.303 | 0.130603 |
| BUNCHER: | −35 | | 8.000 | 39153.824 | 2.303 | 0.130603 |
| FINAL: | −30 | | 32.000 | 78307.648 | 4.606 | 0.261206 |
| EXCITATION: | VOLTAGE: | | | | 130.9059 | kV |
| (Kappa = 1.4) | E (SURFACE): | | | | 73.3073 | MV/m |
| | BRAVERY: | | | | 2.0000 | — |
| BEAM CURRENT: | ELECTRICAL: | | | | 50.0000 | mA |
| | PARTICLE: | | | | 50.0000 | mA |
| | EMITTANCE (N): | | | | 0.0050 | cm-mrad |
| BEAM PULSE: | LENGTH: | | | | 100.0000 | microseconds |
| | REP. RATE: | | | | 60.0000 | Hz |
| | DUTY FACTOR: | | | | 0.6000% | |
| FACTORS: | MODULATION (BUNCHER): | | | | 3.0000 | — |
| | FOCUSING STRENGTH (EFF): | | | | 11.1104 | — |
| | ACCELERATING EFFICIENCY: | | | | 0.7643 | — |
| | FOCUSING EFFICIENCY: | | | | 0.2164 | — |
| | CAPTURE: | | | | 100.00% | |
| LIMITS: | BEAM CURRENT (TRANSVERSE): | | | | 9647.7920 | mA |
| | BEAM CURRENT (LONGITUDINAL): | | | | 734.2210 | mA |
| LENGTHS: | LR = 0.0 LS = 0.0 LG = 0.0 LA = 632.0 LTOT = 632.0 | | | | | |

It is noted that as N increases for a given RFQ linac design, and as the frequency of the field increases, the efficiency of the rf portion of the system may degrade significantly. That is, the rf losses in the system may become excessively large due to surface resistance at high frequencies. To overcome this difficulty, the present four-finger linac structure lends itself to being used with cryogenic facilities, thereby allowing the entire system, e.g., the support tube 54, including all of the individual acceleration cells 40 (FIG. 6A) to be operated at superconducting temperatures. It is also possible for the crossbars and fingers, as well as the cylindrical shell 44, to all be made from the new high temperature superconducting materials, thereby simplifying the cryogenic requirements of such a system.

As thus seen from the above description, the present invention provides revolutionary extensions to the capabilities of RFQ linacs. The four-finger structure described herein does not replace or compete with the conventional, e.g., four-vane structures, but rather extends their useful range by major proportions. The four-finger RFQ structure rectifies major limitations of the conventional RFQ structures, yet it retains the desirable focusing, ruggedness, and compactness features of a conventional RFQ linac. As seen from the examples cited above, the invention provides an RFQ linac that produces small diameter beams having output energies extended up to the range of 8 to 32 MeV.

As also seen above, the present invention provides an improved RFQ linac structure wherein the sign of the quadrupole focussing action in each acceleration cell or gap of the linac is selectively controlled by the four-finger configuration of that cell, thus providing an additional degree of freedom in the design of the RFQ linac structure. Because of this feature, it is possible to selectively design focal periods that are longer than the particle wavelength. Hence, the periodicity of the focal structure becomes independent of the periodicity of the accelerating structure. This represents a major milestone in the design of RFQ linacs.

While the invention herein disclosed has been described by means of specific embodiments and applications thereof, numerous modifications and variations could be made thereto by those skilled in the art without departing from the scope of the invention set forth in the claims.

What is claimed is:

1. A four-finger RFQ linac comprising:

a plurality of increasingly longer accelerating cells, each of said plurality of accelerating cells including a first pair of spaced-apart fingers protruding into the center of the cell from a first end of the cell, said first pair of spaced-apart fingers lying in a first plane, a second pair of spaced-apart fingers protruding into the center of the cell from the other end of the cell, said second pair of spaced-apart fingers lying in a second plane, said second plane being perpendicular to said first plane, a cylindrical shell having a first crossbar structure attached to one end of said shell and a second crossbar structure attached to the other end of said shell, said crossbar structures having an aperture through their center, said first pair of spaced-apart fingers being secured to said first crossbar structure, said second pair of spaced-apart fingers being secured to said second crossbar structure.

means for aligning said plurality of cells so that a charged particle beam may pass uninterrupted through all of said accelerating cells along a beam axis, said beam axis passing through the aperture of said crossbar structures; and means for selectively applying an alternating electric potential of a first frequency to said pairs of spaced-apart fingers so that the first pair of fingers in each cell assumes an opposite potential as the second pair of fingers, whereby a quadrupole electric field is established in a region surrounding said pairs of fingers, said quadrupole electric field having a polarity that varies at ar ate determined by said first frequency, said quadrupole electric field serving to accelerate said charged particles through said accelerating cells in accordance with an inherent acceleration periodicity, and to focus said charged particle beam towards the center of said aperture;

said fingers being oriented in a prescribed pattern from cell to cell so as to provide a specified focusing periodicity, said focusing periodicity being independent of said acceleration periodicity, the specified focusing periodicity of said finger orientation from cell to cell thereby providing an additional degree of freedom in the design of said four-finger linac.

2. The four-finger RFQ linac as set forth in claim 1 further including a support tube into which said plurality of accelerating cells are held.

3. The four-finger RFQ linac as set forth in claim 1 wherein the spacing between said first and second pair of spaced apart fingers increases as said fingers protrude into the center of each cell.

4. The four-finger RFQ linac as set forth in claim 3 wherein said electric potential application means applies the same voltage potential to the spaced apart fingers secured to back-to-back crossbar support structures of adjoining ones of said accelerating cells.

5. The four-finger RFQ linac as set forth in claim 4 wherein said first pair of fingers is secured to a crossbar support structure on a left side of each of said accelerating cells, and said second pair of fingers is secured to a crossbar support structure on a right side of each of said accelerating cells, viewing said RFQ linac horizontally from a side view, and wherein said first plane in which said first pair of spaced apart fingers lie in each electrode set may assume either a horizontal (H) or a vertical (V) position, and wherein the second plane assumes the other of said horizontal (H) or vertical (V) position, and wherein said prescribed periodicity of the orientation of said fingers is determined by a prescribed pattern of positions of said first planes through a prescribed number of adjacent acceleration cells.

6. The RFQ linac structure as set forth in claim 5 wherein the prescribed number of adjacent acceleration cells in said prescribed pattern comprises 2 m, where m is a positive non-zero integer; and wherein said first plane in said 2 m acceleration cells as viewed left-to-right in said pattern, assumes a sequence of m consecutive V positions followed by m consecutive H positions; said second plane in said 2 m electrode sets thereby assuming a sequence of m consecutive H positions followed by m consecutive V positions.

7. An RFQ linac structure for accelerating a beam of charged particles moving along a beam axis, said RFQ linac structure comprising:

a series of spaced-apart electrode sets oriented about said beam axis;

means for charging each spaced-apart electrode set with an electric potential, a first group of electrodes in said electrode set being charged to one polarity, and a second group of electrodes in said electrode set being charged to an opposite polarity, said electric potential alternating a first frequency, whereby a varying electric field is established about said beam axis in a region of each of said spaced-apart electrode sets, said varying electric field serving to focus charged particles in said charged particle beam towards the center of said beam axis as controlled by a particular orientation of said first and second groups of electrodes and by said first frequency, the orientation of said groups of electrodes within said electrode sets being selected to provide a prescribed focusing periodicity through a plurality of adjacent spaced-apart electrode sets;

each of said spaced-apart electrode sets being supported by fronting first and second spaced-apart conductive support bars, each having a longitudinal axis, and each having an aperture through its center, said first and second spaced-apart support bars of each electrode set being positioned so that their respective longitudinal axes are orthogonal, said beam axis passing through the aperture of each support bar, said first group of electrodes comprising a first pair of rigid spaced apart fingers that have a first end secured to said first support bar and extend spatially in a first plane towards said second support bar, said second group of electrodes comprising a second pair of rigid spaced apart fingers that have a first end secured to said second support bar and extend spatially in a second plane towards said first support bar, said first and second planes being perpendicular to each other, the second support bar of a first electrode set being back to back to the first support bar of a second electrode set, said back-to-back support bars having their respective longitudinal axes substantially parallel; and spacing means for increasing the axial distance through the region of each of said spaced-apart electrode sets in a direction along said beam axis corresponding to the direction of said beam of charged particles, said varying electric field serving to move said beam of charged particles along said beam axis at a rate controlled by said first frequency.

8. The RFQ linac structure as set forth in claim 7 wherein said first and second group of electrodes in each of said electrode sets comprise two electrodes, whereby each of said spaced-apart electrode sets include four electrodes, and said varying electric field established about said beam axis comprises a quadrupole electric field.

9. The RFQ linac structure as set forth in claim 7 wherein the spacing between said first and second pair of rigid spaced apart fingers increases as said fingers extend spatially away from their respective support bars.

10. The RFQ linac structure as set forth in claim 7 wherein said electric potential charging means charges the rigid fingers secured to back-to-back support bars in adjoining ones of said spaced-apart electrode sets to the same potential.

11. The RFQ linac structure as set forth in claim 10 wherein said first pair of rigid fingers is secured to a support bar on a left side of each of said electrode sets, and said second pair of rigid fingers is secured to a support bar on a right side of each of said electrode sets, when said RFQ linac structure is positioned horizontally and is viewed from a side view, and wherein said first plane in which said first pair of rigid spaced apart fingers lie in each electrode set may assume either a horizontal (H) or a vertical (V) position, and wherein the second plane assumes the other of said horizontal (H) or vertical (V) position, and wherein said prescribed periodicity of the orientation of said groups of electrodes is determined by a prescribed pattern of positions of said planes through a prescribed number of adjacent electrode sets.

12. The RFQ linac structure as set forth in claim 11 wherein the prescribed number of adjacent electrode sets in said prescribed pattern comprises four; and wherein said first plane in said four electrode sets, as said electrode sets are viewed left-to-right, assumes a sequence of V, V, H, H, . . . positions; said second plane in said four electrode sets thereby assuming a sequence of H, H, V, V, . . . positions.

13. The RFQ linac structure as set forth in claim 11 wherein the prescribed number of adjacent electrode sets in said prescribed pattern comprises six; and wherein said first plane in said six electrode sets, as said electrode sets are viewed left-to-right, assumes a sequence of V, V, V, H, H, H, . . . positions; said second plane in said four electrode sets thereby assuming a sequence of H, H, H, V, V, V, . . . positions.

14. The RFQ linac structure as set forth in claim 11 wherein the prescribed number of adjacent electrode sets in said prescribed pattern comprises 2 m, where m is a positive non-zero integer; and wherein said first plane is said 2 m electrode sets, as viewed left-to-right in said pattern, assumes a sequence of m consecutive V positions followed by m consecutive H positions; said second plane in said 2 m electrode sets thereby assuming a sequence of m consecutive H positions followed by m consecutive V positions.

15. A method of configuring a four-finger RFQ linac to provide a focusing periodicity that is independent of an acceleration periodicity, said four-finger RFQ linac including a plurality of cells, each cell having four-finger electrodes supported by conductive crossbar structure and configured about a beam axis, and means for charging said fourfinger electrodes with an alternating electric charge at a first frequency so as to establish a quadrupole electric field about said beam axis, said alternating quadrupole electric field within a given cell serving to focus a charged particle beam along said beam axis, said alternating quadrupole electric field between adjacent cells serving to move a given charged particle or packet of charged particles within said charged particle beam from one cell to an adjacent cell at a rate determined by the width of each cell and said first frequency, said method comprising the steps of:

(a) increasing the width of said cells as said cells are positioned along said beam axis from an input end of said four-finger RFQ linac to an output end, whereby a given charged particle or packet of charged particles moving through said cell in a time period fixed by said first frequency must traverse increasingly longer distances, whereby said charged particle beam is accelerated as it moves through said RFQ linac, said cell widths in combination with the first frequency of said quadrupole electric field comprising an accelerating structure periodicity; and (b) orienting said four-finger electrodes to assume a prescribed pattern over a prescribed number of adjacent cells so as to provide a desired focusing periodicity, said desired focusing periodicity being independent of the accelerating structure periodicity, and so as to prevent electric fields or currents from flowing or crossing from one cell to an adjacent cell when said four-finger RFQ linac is operated in a resonant cavity mode.

16. The method of configuring a four-finger linac as set forth in claim 15 wherein the step of orienting said four-finger electrodes in a desired focusing periodicity comprises orienting said four-finger electrodes in a periodic sequence over a series of 2 m consecutive cells, where m is an integer having a value of at least two.

* * * * *

UNITED STATES PATENT AND TRADEMARK OFFICE

CERTIFICATE OF CORRECTION

PATENT NO. :5,113,141

DATED :May 12, 1992

INVENTOR(S) : Swenson

It is certified that error appears in the above-indentified patent and that said Letters Patent is hereby corrected as shown below:

On the title page, item [54] and column 1, line 1 change "FINGERS" to --FINGER--. In "OTHER PUBLICATIONS", change "Jamesson" to --Jameson-- and change "Schriber, S.Q." to --Schriber, S.O.--. IN THE ABSTRACT: line 11, change "periodcity" to --periodicity--.

Column 2, line 36, and column 6, line 21, delete "the" (second occurrence).

Column 6, line 23, change "&:o" to --to--.

Column 7, line 56, change "traversely" to --traversed--. Column 7, line 56, change "frequence" to --frequency--. Column 8, line 23, change "$E_S$" (with an uppercase subscript "S") to --$E_s$-- Column 8, line 28, after "in", insert --an--. Column 8, line 40, delete "," (second occurrence) after "42a,". Column 8, line 42, change "on" to --of--. Column 8, line 47, change "is" to --in--. Column 9, line 26, change "cross bars" to --crossbars--. Column 9, line 30, change "nonconductive" to --non-conductive--. Column 10, line 26, change "well" to --will--. Column 10, line 39, change "of" to --on--. Column 12, line 13, change "in" (first occurrence) to --it--. Column 13, line 35, change "penetrate" to --permit--. Column 14, line 18, change "Mev" to --MeV--. Column 14, line 26, change "850 MHZ" to --850 MHz--.

UNITED STATES PATENT AND TRADEMARK OFFICE

CERTIFICATE OF CORRECTION

PATENT NO. : 5,113,141

DATED : May 12, 1992

INVENTOR(S) : Swenson

It is certified that error appears in the above-indentified patent and that said Letters Patent is hereby corrected as shown below:

IN THE CLAIMS: Column 17, line 21, change "." to --;--. Column 17, line 34, change "ar ate" to --a rate--. Column 18, line 15, change "four finger" to --four-finger--. Column 18, line 28, after "alternating", insert --at--.

Signed and Sealed this

Twelfth Day of October, 1993

Bruce Lehman

*Attest:*

BRUCE LEHMAN

*Attesting Officer*

*Commissioner of Patents and Trademarks*